US007674099B2

(12) United States Patent
Dunn

(10) Patent No.: US 7,674,099 B2
(45) Date of Patent: Mar. 9, 2010

(54) COMPRESSOR WITH OIL BYPASS

(75) Inventor: Stephen Dunn, Bethlehem, PA (US)

(73) Assignees: Sumitomo Heavy Industries, Ltd., Tokyo (JP); SHI-APD CRyogenics, Inc., Allentown, PA (US)

( * ) Notice: Subject to any disclaimer, the term of this patent is extended or adjusted under 35 U.S.C. 154(b) by 132 days.

(21) Appl. No.: 11/413,860

(22) Filed: Apr. 28, 2006

(65) Prior Publication Data

US 2007/0253854 A1 Nov. 1, 2007

(51) Int. Cl.
*F01C 21/04* (2006.01)
*F04C 29/02* (2006.01)

(52) U.S. Cl. ..... 418/55.6; 418/2; 418/83; 418/88; 184/6.16

(58) Field of Classification Search ..... 418/2, 418/55.6, 83, 88, 201.1; 184/6.13, 6.16
See application file for complete search history.

(56) References Cited

U.S. PATENT DOCUMENTS

| | | | | |
|---|---|---|---|---|
| 1,967,035 | A * | 7/1934 | Lipman | 184/6.16 |
| 2,906,101 | A | 9/1959 | McMahon et al. | |
| H773 | H * | 5/1990 | Keedwell et al. | 55/498 |
| 5,012,896 | A * | 5/1991 | Da Costa | 418/96 |
| 5,318,151 | A * | 6/1994 | Hood et al. | 418/85 |
| 5,358,392 | A * | 10/1994 | Ukai | 418/94 |
| 5,545,021 | A * | 8/1996 | Fukuoka et al. | 418/63 |
| 5,626,470 | A * | 5/1997 | Gerhardt | 418/84 |
| 6,017,192 | A * | 1/2000 | Clack et al. | 417/18 |
| 6,017,205 | A | 1/2000 | Weatherstone et al. | |
| 6,050,794 | A * | 4/2000 | Noboru et al. | 418/88 |
| 6,428,296 | B1 * | 8/2002 | Elson et al. | 418/55.6 |
| 6,488,120 | B1 | 12/2002 | Longsworth | |
| 6,616,415 | B1 * | 9/2003 | Renken et al. | 417/44.1 |
| 6,644,400 | B2 * | 11/2003 | Irwin, Jr. | 166/75.12 |
| 6,701,745 | B1 * | 3/2004 | Kozinski | 62/503 |
| 7,296,436 | B2 * | 11/2007 | Dekiya | 62/468 |
| 2004/0109771 | A1 * | 6/2004 | Ioi et al. | 417/410.5 |
| 2004/0154330 | A1 * | 8/2004 | Ko et al. | 418/83 |
| 2005/0129559 | A1 * | 6/2005 | Hasegawa et al. | 418/88 |

FOREIGN PATENT DOCUMENTS

| | | | |
|---|---|---|---|
| JP | 01063694 A | * | 3/1989 |
| JP | 01155087 A | * | 6/1989 |

(Continued)

OTHER PUBLICATIONS

R.C. Longsworth, Helium Compressor for GM and Pulse-tube Expanders, in "Advances in Cryogenic Engineering", vol. 47, Amer. Inst. of Physics, 2002, pp. 691-697.

*Primary Examiner*—Thomas E Denion
*Assistant Examiner*—Mary A Davis
(74) *Attorney, Agent, or Firm*—Katten Muchin Rosenman LLP

(57) ABSTRACT

An oil lubricated compressor which includes a bypass oil line connecting respective oil paths upstream and downstream of the motor. The bypass oil path permits oil to be detoured around the motor in a tube that is external to the compressor shell and flows back into the shell near the scroll inlet. The oil bypass line returns "excess" oil directly to sump 28, rather than having it flow from sump 27 to sump 28 through an air-gap, thereby reducing both the drag on the motor and the input power.

16 Claims, 4 Drawing Sheets

FOREIGN PATENT DOCUMENTS

| | | | | |
|---|---|---|---|---|
| JP | 02277986 | A | * | 11/1990 |
| JP | 06002687 | A | * | 1/1994 |
| JP | 06017774 | A | * | 1/1994 |
| JP | 06033890 | A | * | 2/1994 |
| JP | 06058281 | A | * | 3/1994 |

* cited by examiner

COMPRESSOR WITH OIL BYPASS

BACKGROUND OF THE INVENTION

This invention relates generally to helium compressor units for use in cryogenic refrigeration systems, operating on the Gifford McMahon (GM) cycle. More particularly, the invention relates to an improved oil cooling structure for a scroll type oil-lubricated compressor unit adapted to compressing helium by orienting it horizontally.

A refrigeration compressor has a need for lubrication of moving parts such as bearings and gears. These compressors contain oil sumps to direct oil from the sump to each lubrication point. Oil-lubricated air conditioning compressors have become standard for delivering pressurized helium to GM type cryogenic refrigerators. The ability to use these relatively inexpensive but reliable compressors results from developing methods to cool the helium as it is being compressed, and the development of oil separators and adsorbers that reliably keep oil out of the cold expander of a GM type refrigeration system. Because helium gets much hotter during compression than standard air-conditioning refrigerants it is frequently cooled by flowing a significant amount of oil along with the helium through the compression chamber. Additionally, the compressor units also generate heat in the compression of helium. Therefore, the purpose of oil in GM type cryogenic refrigeration is both lubrication and to absorb the heat produced in the process of helium compression.

The basic principal of operation of a GM cycle refrigerator is described in U.S. Pat. No. 2,906,101 to McMahon, et al. The GM cycle has become the dominant means of producing cryogenic temperatures in small commercial refrigerators primarily because it can utilize mass produced oil-lubricated air-conditioning compressors to build reliable, long life, refrigerators at minimal cost. GM cycle refrigerators operate well at pressures and power inputs within the design limits of air-conditioning compressors, even though helium is substituted for the design refrigerants. Typically, GM refrigerators operate at a high pressure (Ph) of about 2 MPa (300 pounds per square inch absolute) (psia), and a low pressure of about 0.8 MPa (117 psia).

Air-conditioning compressors are built in a wide range of sizes and several different designs. Means of providing additional cooling to adapt these compressors to compressing helium are different for different compressors. For example, compressors that draw approximately 200 to 600 W are typically reciprocating piston types which are cooled by adding air cooled fins to the compressor shell. Between about 800 to 4,500 W, the most common compressor is a rolling piston type with low pressure return gas flowing directly onto the compression chamber. In rolling piston compressors, oil flows into the compression chamber along with the helium and absorbs heat from the helium as it is being compressed. Most of the oil separates from the helium in the compressor shell which is at high pressure. U.S. Pat. No. 6,488,120 to Longsworth describes the cooling of helium, oil, and the compressor shell by wrapping a water cooling tube around the shell, and further wrapping a helium cooling tube and an oil cooling tube over the water tube. Cooled oil is then injected into the return helium line. In effect, the compressor serves as an oil pump. The amount of oil pumped is typically about 2% of the displacement.

A problem with the oil cooling system is the flow rate and temperature of the cooling water are very important and must be monitored carefully. Failure to monitor reduces the effectiveness of the oil separators, causes overheating, and increases the likelihood of compressor shutdown or failure.

The Hitachi Corporation manufactures scroll compressors which draw between 5 and 9 kW and have return gas flow directly into the scroll. Oil can be injected into the inlet and discharged with the helium into the shell at high pressure. Most of the oil separates from the helium and collects in the bottom of the compressor, similar to the rolling piston compressor described above. Unlike the smaller compressor, for this type of compressor, cooling the shell with a water cooling tube wrapped around it is not effective. Here, heat from the helium and oil is removed by an after-cooler that is either air or water cooled.

The Copeland Compressor Corporation manufactures scroll compressors for air-conditioning service that draw between 5 and 15 kW. These compressors differ from the Hitachi design in that the return gas flows into the shell, which is at low pressure, rather than directly into the scroll. In the standard vertical orientation, in which the scroll is above the motor, no means exist to have cooling oil flow into the compression chamber with the helium. Copeland has modified two compressors, a 5 and a 7.5 kW compressor, to circulate oil for cooling helium by collecting high pressure oil in the discharge plenum above the scroll then having it flow out through a special port to be cooled in an external after-cooler. Another special return port brings oil back into the scroll near low pressure where it mixes with helium that is being compressed.

A description of the construction and operation of a scroll compressor, and the specific changes to adapt the Copeland standard unit to compressing helium, is found in U.S. Pat. No. 6,017,205 to Weatherston, et al. A compressor system that uses the larger of the two compressors that are manufactured for helium service together with a description of the entire compressor system, of which the compressor is an essential component, is described in R. C. Longsworth, "Helium Compressor for GM and Pulse-tube Expanders", in "Advances in Cryogenic Engineering", Vol. 47, Amer. Inst. of Physics, 2002, pp 691-697.

In an effort to reduce the cost of applying the above scroll compressors to applications that require oil injection for cooling, Copeland successfully oriented the compressors horizontally. In the Copeland compressor, oil in the bottom of the compressor at low pressure flows into the scroll due to gravity along with the gas being compressed. The only modification to a standard vertical compressor is the addition of a port at the bottom center of the compressor. In the horizontal orientation, oil, which would normally be pumped from the oil sump in the bottom of the compressor up the drive shaft to lubricate the bearings and scroll, is directed at the end of the drive shaft after it is cooled in an after-cooler. More oil flows into the scroll with the helium than when oriented vertically. However, a problem with the horizontal orientation is that more oil is circulated than is needed to lubricate the bearings and the "excess" collects in the bottom of the shell. The excess oil flows through the "air" gap in the motor to the scroll, thereby putting significant drag on the motor.

When a standard Copeland scroll compressor is operated horizontally, the cooling oil directed into the end of the drive shaft contains a large fraction of oil in excess of the amount needed to lubricate the bearings. The excess falls to the bottom of the compressor shell and much of it flows through the "air" gap between the rotor and stator to get to the scroll inlet, where it is pumped along with the helium to high pressure. The oil in the "air" gap and the resultant drag causes the motor to draw more power than when the compressor is operated in the vertical position.

A further problem with the horizontal orientation is greater vibration. In addition to inherent vibration from the compressor, operating the standard Copeland scroll compressor horizontally, results in even greater vibration due to oil in the "air" gap.

Accordingly, there exists a need to improve the oil cooling system of Copeland type horizontally oriented oil-lubricated compressors. The present invention is made in view of the above described problems. It is, therefore, desirable to have a oil-lubricated compressor that reduces drag on the motor. It is also desirable to have an efficient oil-lubricated compressor utilizing reduced input power, that can be operated at variable speeds, and having reduced vibration.

None of the references disclose an oil bypass such that when the oil returning from the after-cooler is divided into two streams, one that lubricates the bearings plus an excess that drops to a sump, and a second that bypasses the motor in a tube that is external to the compressor shell and flows back into the shell near the scroll inlet, the input power is reduced by a significant amount.

SUMMARY OF THE INVENTION

It is an object of the present invention to provide a new and improved oil lubricated compressor such that oil can flow into the intake of the compression chamber by gravity and bypass more than half of the oil around the motor by dividing the oil returning from the after-cooler into two streams, a first oil fraction that lubricates the bearings and which contains an excess that drops to a sump, and a second oil fraction that bypasses the motor in a tube that is external to the compressor shell and flows back into the shell near the scroll inlet.

According to one aspect of this invention, there is provided an oil lubricated compressor such that oil can flow into a compression chamber inlet by gravity, comprising: an oil sump at the pressure of a return gas; a first return oil fraction impinging on a first end of a drive shaft; a motor which turns the drive shaft located between said first end of said drive shaft and a second end; a compression chamber, driven by the second end of said drive shaft; and a second oil fraction flowing into a compressor shell between the motor and the compression chamber inlet.

It is also an object of the present invention to provide an oil bypass system that bypasses most of the oil around the motor, improve the oil-balancing effect, thereby reducing drag on the motor.

It is also an object of the present invention to provide an oil bypass system which reduces input power.

It is a further object of the present invention to provide an oil bypass system that reduces compressor vibration or compressor noise.

It is also a further object of the present invention is to provide a compressor where the flow rates of the first and second oil fractions are determined by either fixed or variable orifices.

Yet another object of the present invention is to provide a compressor in which the variable orifice is automatically adjusted during operation of the compressor, allowing for operation at variable speeds.

Other objects and advantages of the invention will become apparent with reference to the following description and the accompanying drawings.

DESCRIPTION OF THE PREFERRED EMBODIMENTS

Figure 1:
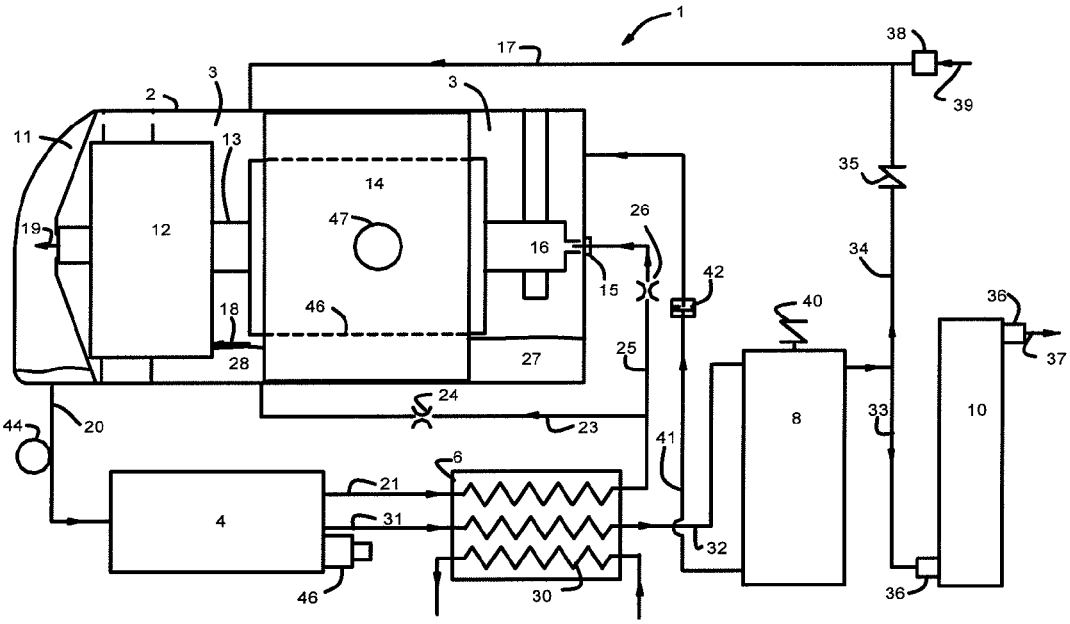
FIG. 1 is a schematic diagram of an oil-lubricated helium compressor system in accordance with the present invention that shows a standard Copeland scroll compressor mounted horizontally, with an oil bypass system.

Referring to FIG. 1, there is shown the preferred embodiment of the present invention, a new oil bypass device for use in compressor units. The novel oil bypass device is used in an oil-lubricated helium compressor unit 1 in accordance with the invention and includes a compressor shell 2 that contains a compressor scroll set 12 driven by a motor 14 through drive shaft 13. Oil is contained within compressor shell 2 on either side of the motor 14 in oil sumps 27 and 28. The motor 14 consists of a rotor that is attached to the drive shaft 13 and an outer stator that is separated from the rotor by "air" gap 46. Although referred to herein as the "air" gap 46, the gap actually has helium in it in the present application. In comparison to the prior art "air gap" which has a significant amount of oil flow through it, the amount of oil flowing through the "air-gap" of the present invention is greatly reduced. The shell 2 has a volume 3 at the return (low) pressure and a volume 11 at supply (high) pressure. The compressor 2 is a type that is used for compressing refrigerants used in air-conditioning service and is typically vertically oriented with the scroll above the motor and the oil sump at the bottom. The end of the drive shaft 13 below the motor 14 contains an oil pump 16 that picks up oil from the sump to pump it through a hole in drive shaft 13 that has ports to lubricate a lower bearing, an upper bearing, and to inject some oil into the compression chambers in the scroll set.

When refrigerants, such as helium, are compressed, the temperature rise during compression is much greater than for refrigerants used for air-conditioning. These high temperatures can cause the oil to break down and the scrolls to become deformed. By having a relatively large amount of oil flow through the compression chamber with the helium, the temperatures can be kept within acceptable limits. In order to do this with minimal changes to a standard compressor, Copeland has adapted a compressor to be mounted horizontally.

Most of the heat of compression leaves the compressor in the oil which is then cooled and returned to the compressor via an oil return port 15.

Figure 2:
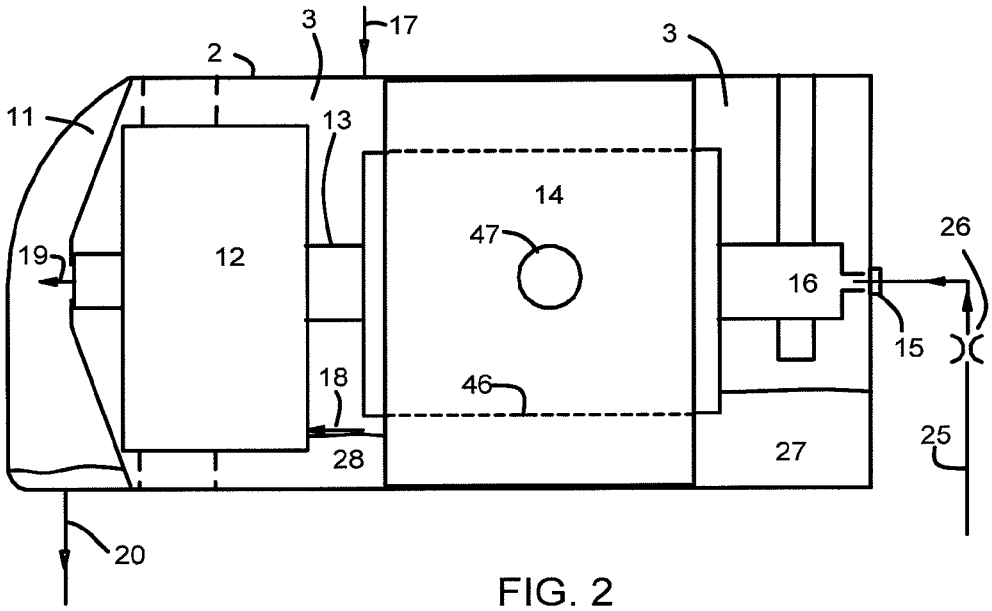
FIG. 2 Prior Art
FIG. 2 is a schematic diagram of an oil-lubricated helium compressor that shows a standard Copeland scroll compressor mounted horizontally, with a port that allows oil which is returning from the after-cooler to impinge on the oil pump end of the drive shaft. This configuration represents prior art.

Conventionally, prior to the present invention, oil flowed through the gap, commonly called the "air" gap, between the motor stator and the rotating windings to get into sump 28, from whence it flowed into the compression chamber along with the helium. FIG. 2 shows the Copeland compressor as manufactured with all of the return oil flowing through port 15. The excess oil that is in sump 27 has a level that is above the "air" gap while the inlet to the scroll is below the "air" gap. Thus, the oil level in sump 28 is below the "air" gap. The air-gap is restrictive for oil flow, thus the level of oil in sump 27 is high enough above the bottom of the "air" gap to provide the pressure head needed to have it flow through the "air" gap into sump 28. The oil level in sump 27 in the original design varies in height as the oil flow rate changes under different operating conditions. This results in a change in the depth of oil in bulk oil separator 4. Of greater importance is the power that is dissipated due to the drag on the motor from the oil in the "air" gap.

Figure 3:
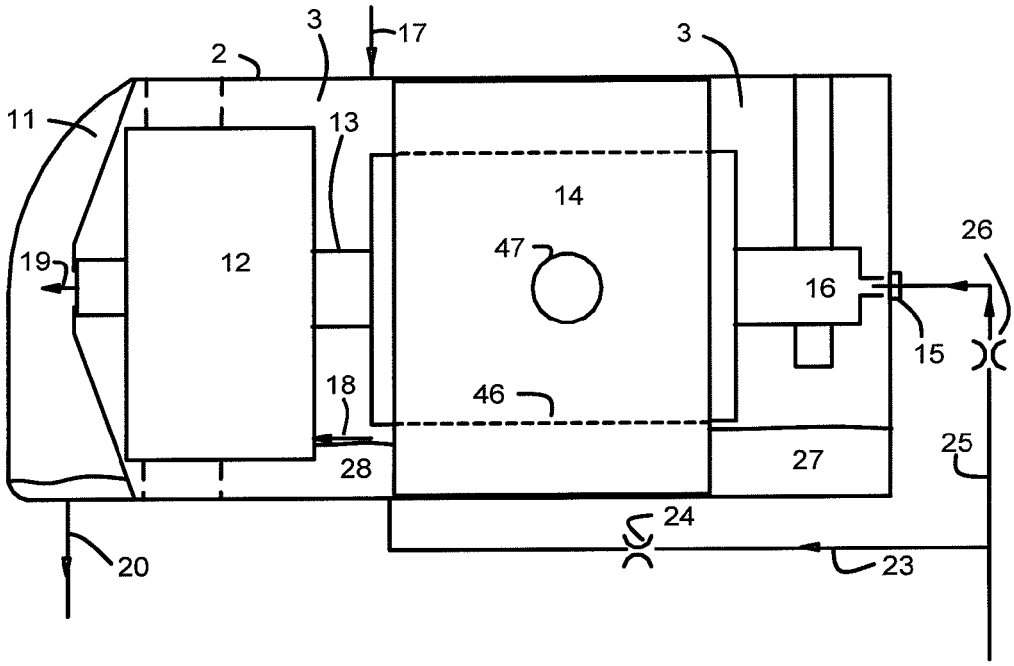
FIG. 3 is a schematic diagram of an oil-lubricated helium compressor in accordance with the present invention that shows a standard Copeland scroll compressor mounted horizontally with oil which is returning from the after-cooler to be split into two fractions, one that flows to a port that allows oil to impinge on the oil pump end of the drive shaft, and a second that bypasses the motor and flows into the shell near the inlet to the scroll.

In comparison with this, in accordance with the present invention, by adding an oil bypass line 23, as shown in FIGS. 1 and 3, to return more than half of the oil that is returning from the after-cooler directly to sump 28, rather than have it flow from sump 27 to sump 28 through the "air" gap, the drag on the motor is reduced, as is the input power. Oil that has been cooled flows through port 15 and impinges on the end of drive shaft 13 where a first oil fraction is picked up by oil pump 16, and a second "excess" oil fraction drops into oil sump 27.

Figure 4:
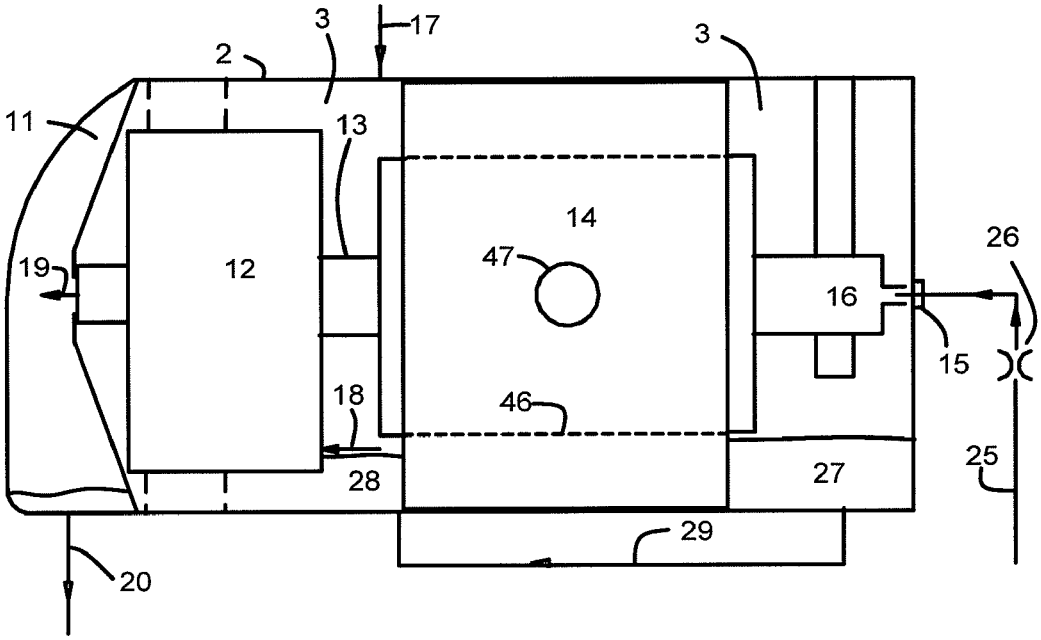
FIG. 4 is a schematic diagram of an oil-lubricated helium compressor in accordance with the present invention that shows a standard Copeland scroll compressor mounted horizontally, with a port that allows oil which is returning from the after-cooler to impinge on the oil pump end of the drive shaft, excess oil dropping to the sump between the motor and the pump end of the drive shaft. All of the excess oil then flows to scroll inlet through an external tube that bypasses the motor.

In an alternative embodiment shown in FIG. 4, bypass line 29 originates in sump 27 rather than line 25. All of the "excess" oil flows through bypass line 29 and the oil level in sump 27 is below the "air" gap.

The total oil circulation rate and the flow split are set by the sizes of orifices 24 and 26. That is, the orifices control the amount of oil allowed to pass through. When a high fraction of oil bypasses the compressor motor, the oil level in sump 27 may be slightly above the "air" gap in sump 28, as illustrated by the solid line that shows the oil level in FIGS. 1 and 3, or if there are some passages through the stator of motor 14, the oil level might be slightly below the "air" gap.

Speed control devices are available that permit the compressor of the present invention to be operated at variable speeds. The oil flow rates may be adjusted during operation by having the bypass oil orifice 24 and the bearing orifice 26 be variable rather than fixed. Orifices 24 and 26 can be automatically adjusted while the compressor is operating, to optimize the oil flow rates for different operating conditions, and changes in operating speed. That is, the flow rates of the first and second oil fractions of the compressor are determined by either fixed or variable orifices. The variable orifice may be automatically adjusted during operation of the compressor.

Refrigerator as used herein refers to cryorefrigerators.

Generally, a compressor is a mechanical device that takes in gas at one pressure, generally low, and increases it to a higher pressure. Compressor, as used herein, is defined as the part of a cryogenic refrigerator that provides the necessary helium gas flow rate for the cryorefrigerator system. More specifically, as used herein the compressor is an oil lubricated, scroll compressor, which generates heat in the compression of helium. However, nothing limits the compressor of the present invention to this type. Other types of compressors which have cooling oil flowing through the "air" gap, such as reciprocating, centrifugal, diaphram and screw type may be used.

As referred to herein "excess" oil refers to the oil that flows through port 15 and drops into sump 27.

In greater detail, arrow 18 in all of the FIGS. denotes the helium entering the compression chamber along with oil from sump 28. Arrow 19 denotes the helium/oil mixture leaving the compression chamber and flowing into high pressure plenum 11. From there the mixture flows through line 20 to bulk oil separator 4 where most of the oil leaves through a line 21 and less than 0.1% of the oil leaves with the helium through line 31. Both flow streams in lines 21 and 31 flow through after-cooler 6 which cools both streams by the counterflow of cooling water through 30. Cooled oil flows through line 25 and orifice 26 into port 15 where it provides lubrication for the bearings, and through line 23 and orifice 24 into sump 28. Cooled helium flows through line 32 to oil separator 8 which removes most of oil that is not separated in bulk oil separator 4. Separated oil collects in the bottom of 8 and returns to low pressure volume 3, in compressor 2, through line 41 and filter/orifice 42. From separator 8 the helium with only a trace of oil in the form of a mist flows through line 33 to the adsorber 10 which removes all but oil vapor before it leaves through the supply line 37; the adsorber traps and holds contaminants. Its primary purpose is to remove all traces of elements, such as water vapor, from the helium gas, but principally oil. The supply line 37 takes the helium to the expander (not shown). Helium returns from the expander low pressure through line 39 and continues on through line 17 to flow into compressor volume 3. Self-sealing couplings 36 allow lines 33 and 37 to be disconnected and the adsorber to be replaced without losing helium. Self-sealing coupling 38 allows line 39 to be removed without losing helium. The system is protected from being over pressurized by atmospheric relief valve (ARY) 40. During cool down, or operation without lines 37 or 39 connected, excess pressure difference between the high pressure and low pressure side of the system is limited by internal relief valve 35 in line 34. Temperature switches 47 and 44 are typical of switches that will shut down the compressor if safe operating temperatures are exceeded.

The present assignees have already disclosed an invention which contributes to an improvement of this type of oil-lubricated compressor. The bulk oil separator 4 is shown as having oil level switch 46. Since the oil level in compressor 2 is nearly constant, the oil level in the bulk oil separator drops over a long period of time as oil collects in the adsorber 10. This provides a means of making the compressor "fail safe" as described in U.S. Pat. No. 6,488,120 which is incorporated herein in its entirety. This patent specifies that the compressor will shut down before the adsorber becomes more than about 75% loaded, oil (mist) never leaving the adsorber. The nearly constant oil levels in the compressor 2 makes it possible to add oil above the level at which an oil level sensor or switch 46 opens to shut down the compressor without having a large difference between the maximum amount of extra oil that can be added and have it open with less than the adsorber 8 being 75% loaded, and the minimum amount of oil that might collect in adsorber 8 when the level switch 46 opens. The difference in the maximum and minimum oil levels are due to a tolerance on the initial oil charge in the system and changes in oil level during operation at different temperatures and pressures.

Advantages of this invention are that an oil bypass line further improves the oil-balancing and the efficacy of the operation of the compressor. A further advantage is the prevention of the degradation of performance when the oil-lubricated compressor is operated in the horizontal orientation as in the modified Copeland compressor.

EXAMPLE 1

For a compressor that has a displacement of 338 L/min and an oil circulation rate of about 7 L/min, the input power at 60 Hz was reduced from 8,300 W to 8,000 W when 5 L/min of oil bypasses motor 14 by flowing through line 23.

The preferred embodiment of the invention relates to GM refrigerators and particularly Copeland scroll type compression refrigeration units used for air conditioners. However, the present invention may be adaptable for other types of scroll type compressors in compression type refrigeration units.

In alternative embodiments, the compressor could include additional valves, apertures or passages to control oil in excess of the amount needed to lubricate the bearings. Also, it is also to be understood that the phraseology and terminology used herein is for the purpose of description and should not be regarded as limiting.

While this invention has been described, it will be understood that it is capable of further modification, uses and/or adaptations of the invention following in general the principal of the invention and including such departures from the present disclosure as come within known or customary practice in the art to which the invention pertains, and as may be applied to the essential features hereinbefore set forth, as fall within the scope of the invention or the limits of the appended claims.

What is claimed is:

1. An oil lubricated compressor operating horizontally wherein oil flows into a compression chamber inlet by gravity, comprising:

a first oil sump at the pressure of a return gas, wherein said return gas is Helium;

a first return oil fraction impinging on a first end of a drive shaft and flowing to a compression chamber internal to the compressor;

a motor which turns the drive shaft located between said first end of said drive shaft and a second end;

said compression chamber, driven by the second end of said drive shaft;

a second oil fraction flowing into said first oil sump located in a compressor shell between the motor and the compression chamber inlet, said second oil fraction flowing into the compression chamber with said return gas; and an oil bypass line external to the compressor shell, wherein the oil bypass line returns said second oil fraction to the first oil sump at the pressure of said return gas, and said second oil fraction is greater than said first return oil fraction.

2. The oil lubricated compressor as in claim 1, whereby said second oil fraction flows from either an oil return line or from a second oil sump into the compressor shell near a scroll inlet, said second oil sump located in said compressor shell on the other side of said motor from said first oil sump.

3. The oil lubricated compressor as in claim 2, wherein the oil bypass line originates at the second oil sump.

4. The oil lubricated compressor as in claim 2, wherein the oil bypass line originates at the oil return line.

5. The oil lubricated compressor as in claim 1, wherein the flow rates of said first and second oil fractions are determined by either fixed or variable orifices.

6. The oil lubricated compressor as in claim 5, wherein said variable orifice is automatically adjusted during operation of the compressor to allow for operation of the compressor at variable speeds.

7. A refrigerator including the oil lubricated compressor as in claim 1.

8. The oil lubricated compressor as in claim 1 further comprising a means of making the compressor fail safe so that the compressor shuts down when a low oil level in a bulk oil separator triggers an oil level sensor or switch.

9. The oil lubricated compressor as in claim 1, wherein oil flow rates through the compression chamber is about 2% of the displacement.

10. A method for reducing the input power, vibration and drag on a horizontally oriented oil lubricated compressor wherein oil flows into a compression chamber inlet by gravity comprising the steps of:

dividing the oil returning from an after-cooler into two oil return fractions, a first return oil fraction impinging on a first end of a drive shaft, and flowing to a compression chamber internal to the compressor; and a second return oil fraction flowing into said compression chamber with a return gas, wherein said second return oil fraction is greater than said first return oil fraction, and said return gas is Helium; and flowing the second return oil fraction through a line external to a compressor shell into the compressor shell between a motor and the compression chamber inlet at the pressure of said return gas bypassing said motor.

11. The method as in claim 10, wherein said first return oil fraction lubricates bearings.

12. The method as in claim 10, wherein a flow rate of said first and second return oil fractions are determined by either fixed or variable orifices.

13. The method as in claim 12, wherein the variable orifice is automatically adjusted during operation of the compressor to allow for operation of the compressor at variable speeds.

14. The method as in claim 10, further comprising shutting down the compressor when an oil level in a bulk oil separator triggers an oil level sensor or switch.

15. The method as in claim 10, wherein the second return oil fraction is returned into the compressor shell between a motor and a compression chamber inlet by said line external to the compressor shell at the pressure of said return gas.

16. The method as in claim 10, wherein oil flow rates through the compression chamber is about 2% of the displacement.

* * * * *